US007459852B2

(12) United States Patent
Hong et al.

(10) Patent No.: US 7,459,852 B2
(45) Date of Patent: Dec. 2, 2008

(54) PLASMA DISPLAY PANEL HAVING DIFFERENT STRUCTURES ON DISPLAY AND NON-DISPLAY AREAS

(75) Inventors: Chong-Gi Hong, Asan-si (KR); Tae-Kyoung Kang, Asan-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 0 days.

(21) Appl. No.: 10/982,910

(22) Filed: Nov. 8, 2004

(65) Prior Publication Data

US 2005/0104520 A1 May 19, 2005

(30) Foreign Application Priority Data

Nov. 17, 2003 (KR) ..... 10-2003-0081112

(51) Int. Cl.
*H01J 17/49* (2006.01)

(52) U.S. Cl. ..... 313/584; 313/583; 313/582

(58) Field of Classification Search ..... 313/582–587
See application file for complete search history.

(56) References Cited

U.S. PATENT DOCUMENTS

| | | | | |
|---|---|---|---|---|
| 5,429,914 | A | 7/1995 | Kojima et al. | |
| 5,541,618 | A | 7/1996 | Shinoda | 345/60 |
| 5,661,500 | A | 8/1997 | Shinoda et al. | 345/60 |
| 5,663,741 | A | 9/1997 | Kanazawa | 345/66 |
| 5,674,553 | A | 10/1997 | Shinoda et al. | 427/68 |
| 5,724,054 | A | 3/1998 | Shinoda | 345/60 |
| 5,786,794 | A | 7/1998 | Kishi et al. | 345/60 |

(Continued)

FOREIGN PATENT DOCUMENTS

| | | |
|---|---|---|
| JP | 02-148645 | 6/1990 |

(Continued)

OTHER PUBLICATIONS

*"Final Draft International Standard"*, Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

(Continued)

*Primary Examiner*—Karabi Guharay
(74) *Attorney, Agent, or Firm*—Robert E. Bushnell, Esq.

(57) ABSTRACT

A Plasma Display Panel (PDP) includes: a front substrate, common scan electrodes arranged on a lower surface of the front substrate, a bus electrode electrically connected to the common and scan electrodes, a rear substrate facing the front substrate, an address electrode arranged on an upper surface of the rear substrate to cross the bus electrode. The bus electrode includes a display unit bus electrode arranged on a display area, and a non-display unit bus electrode arranged on a non-display area electrically connected to the display unit bus electrode and an external terminal. The display unit bus electrode and the non-display unit bus electrode have different structures. The non-display unit bus electrode arranged on the non-display area has a single-layered structure while the display unit bus electrode arranged on the display area has a double-layered structure.

10 Claims, 12 Drawing Sheets

U.S. PATENT DOCUMENTS

| | | | | |
|---|---|---|---|---|
| 5,952,782 | A | 9/1999 | Nanto | 313/584 |
| 6,025,020 | A | 2/2000 | Chen et al. | |
| 6,075,319 | A * | 6/2000 | Kanda et al. | 313/584 |
| RE37,444 | E | 11/2001 | Kanazawa | 345/60 |
| 6,346,772 | B1 * | 2/2002 | Nishiki et al. | 313/587 |
| 6,465,956 | B1 * | 10/2002 | Koshio et al. | 313/586 |
| 6,630,916 | B1 | 10/2003 | Shinoda | 345/60 |
| 6,707,436 | B2 | 3/2004 | Setoguchi et al. | 345/60 |
| 6,864,630 | B2 * | 3/2005 | Fujiwara | 313/584 |
| 6,891,331 | B2 * | 5/2005 | Ashida et al. | 313/582 |

FOREIGN PATENT DOCUMENTS

| | | |
|---|---|---|
| JP | 2845183 | 10/1998 |
| JP | 2917279 | 4/1999 |
| JP | 11-273578 | 10/1999 |
| JP | 2001-043804 | 2/2001 |
| JP | 2001-325888 | 11/2001 |
| JP | 2002-373596 | 12/2002 |
| JP | 2003-068216 | 3/2003 |
| JP | 2003-197093 | 7/2003 |
| WO | WO 02/19369 A1 | 3/2002 |

OTHER PUBLICATIONS

Office Action from the Japanese Patent Office issued in Applicant's corresponding Japanese Patent Application No. 2004-322764 dated Jun. 5, 2007.

* cited by examiner

PLASMA DISPLAY PANEL HAVING DIFFERENT STRUCTURES ON DISPLAY AND NON-DISPLAY AREAS

CLAIM OF PRIORITY

This application makes reference to, incorporates the same herein, and claims all benefits accruing under 35 U.S.C. §119 from an application for PLASMA DISPLAY AND METHOD OF FABRICATING THE SAME earlier filed in the Korean Intellectual Property Office on 17 Nov. 2003 and there duly assigned Serial No. 2003-81112.

BACKGROUND OF THE INVENTION

1. Field of the Invention

The present invention relates to a plasma display panel, and more particularly, to a plasma display panel having bus electrodes of different respective structures on a display area and a non-display area.

2. Description of the Related Art

A Plasma Display Panel (PDP) is a flat display device that displays letters or graphics using light emitted by plasma generated in a gas discharge process. The PDP can be either a Direct Current (DC) PDP, in which an electrode for applying voltages from the outside is directly exposed to the plasma and a conduction current flows directly through the electrode, or an Alternating Current (AC) PDP, in which an electrode is covered by a dielectric and is not directly exposed to the plasma and a displacement current flows therethrough.

In a PDP, a sustain electrode is formed on a front substrate and the sustain electrode is covered by a front dielectric layer. A protective layer is formed on the front dielectric layer.

An address electrode is formed on a rear substrate that is disposed to face the front substrate and a rear dielectric layer is formed on the address electrode. A barrier rib that defines the discharge space is formed on the rear dielectric layer and a phosphor layer of red, green, and blue colors formed on an upper surface of the rear dielectric layer and an inner surface of the barrier rib.

On the other hand, an inner space between the front and rear substrates is a discharge space, into which an inert gas is injected.

Alternatively, a PDP includes a front substrate and a rear substrate.

A sustain electrode, which includes alternately disposed X stripe electrodes and Y stripe electrodes, is formed on a lower surface of the front substrate and a bus electrode is electrically connected to the X and Y electrodes along the edges of the X and Y electrodes The X and Y electrodes and the bus electrode are covered by a front dielectric layer, and a protecting layer is coated on a surface of the front dielectric layer.

An address electrode crossing the sustain electrode is formed on an upper surface of the rear substrate and the address electrode is covered by a rear dielectric layer. A barrier rib that defines a discharge space is disposed on the rear dielectric layer. A phosphor layer of red, green, and blue colors is applied on an inner surface of the barrier rib and a surface of the rear dielectric layer.

The front substrate can be divided into a display area A that realizes images by forming pixels, and non-display areas B and C that are electrically connected to external terminals to transmit electric signals.

The bus electrode is formed on the sustain electrode that is formed on the front substrate. The bus electrode has a dual-layered structure including a first bus electrode coated on the surface of the sustain electrode and a second bus electrode coated on an upper surface of the first bus electrode.

The first bus electrode is a black layer functioning as a shielding layer, and the second bus electrode is a white conductive layer. In addition, the first and second bus electrodes have equal thicknesses on the display area A and the non-display areas B and C.

However, the bus electrode formed on the PDP has the following problems.

The bus electrode formed on the front substrate has the dual-layered structure including the black first bus electrode and the white second bus electrode on the display area and the non-display area.

When a raw material for forming the bus electrode is printed and developed, the first bus electrode is more vulnerable to a developing solution than the second bus electrode. Thus, undercut portions are generated on both edges of the bus electrode when it is formed.

Also, during an exposure process, since the first bus electrode receives less ultraviolet rays than the second bus electrode, the first bus electrode is less hardened than the second bus electrode. Thus, the first bus electrode has a larger undercut portion than the second bus electrode. If the undercut portion is large, it may cause a short.

In addition, due to the undercut portion, both edge portions of the bus electrode do not tend to contract downward. However, a center portion of the bus electrode tends to contract downward. Accordingly, the center portion of the bus electrode descends due to the contraction, and the edge portions rise, forming an edge curl portion on the bus electrode. When the edge curl portion is formed, a withstand voltage of the PDP is lowered.

In addition, since the thickness of the bus electrode patterned on the front substrate is constant on the display area and on the non-display area, the cost of fabricating the bus electrode on the non-display area that is electrically connected to the external terminal increase greatly when the size of the PDP becomes larger. On the non-display area, the black layer that is formed to improve the contrast on the display area is unnecessary.

SUMMARY OF THE INVENTION

The present invention provides a Plasma Display Panel (PDP) having improved contrast and brightness by forming a bus electrode to have different respective structures of electrodes on a display area and on a non-display area of a substrate, and a method of fabricating the PDP.

According to an aspect of the present invention, a plasma display panel is provided including: a front substrate; a common electrode and a scan electrode arranged on a lower surface of the front substrate; a bus electrode electrically connected to the common electrode and the scan electrode; a front dielectric layer covering the common electrode, the scan electrode, and the bus electrode; a rear substrate facing the front substrate; an address electrode arranged on an upper surface of the rear substrate to cross the bus electrode; a barrier rib arranged between the front and rear substrates; and a phosphor layer arranged on a discharge space defined by the barrier rib; wherein the bus electrode includes a display unit bus electrode arranged on a display area that displays pixels and a non-display unit bus electrode arranged on a non-display area electrically connected to the display unit bus electrode and connected to an external terminal, and wherein the display unit bus electrode and the non-display unit bus electrode have different structures.

The display unit bus electrode preferably comprises a dual-layered structure of a first bus electrode and a second bus electrode arranged on the first bus electrode.

The second bus electrode is preferably wider than the first bus electrode.

The first bus electrode is preferably black.

The first bus electrode preferably comprises cobalt, chrome, or ruthenium mixed with a frit.

The second bus electrode is preferably white.

The second bus electrode preferably comprises silver, aluminum, or copper mixed with a frit.

The non-display unit bus electrode preferably comprises a single-layered structure electrically connected to the external terminal.

The non-display unit bus electrode preferably comprises a same material as one electrode in the display unit bus electrode.

The non-display unit bus electrode is preferably wider than the display unit bus electrode.

An undercut portion and an edge curl portion are preferably arranged along edges of the display unit bus electrode and the non-display unit bus electrode.

An undercut portion c of the display unit bus electrode, an undercut portion e of the non-display unit bus electrode, a height d of the edge curl portion on the display unit bus electrode, and a height f of the edge curl portion on the non-display area preferably satisfy the following:

$$c>e,\ d>f$$

$$0.1\ \mu m \leqq c \leqq 25\ \mu m,\ 0\ \mu m \leqq e \leqq 25\ \mu m,$$

$$0.1\ \mu m \leqq d \leqq 15\ \mu m,\ \text{and}\ 0\ \mu m \leqq f \leqq 10\ \mu m.$$

The display unit bus electrode preferably includes a white first bus electrode and a white second bus electrode arranged on the first bus electrode.

BRIEF DESCRIPTION OF THE DRAWINGS

A more complete appreciation of the present invention, and many of the attendant advantages thereof, will be readily apparent as the present invention becomes better understood by reference to the following detailed description when considered in conjunction with the accompanying drawings in which like reference symbols indicate the same or similar components, wherein.

DETAILED DESCRIPTION OF THE INVENTION

Figure 1:
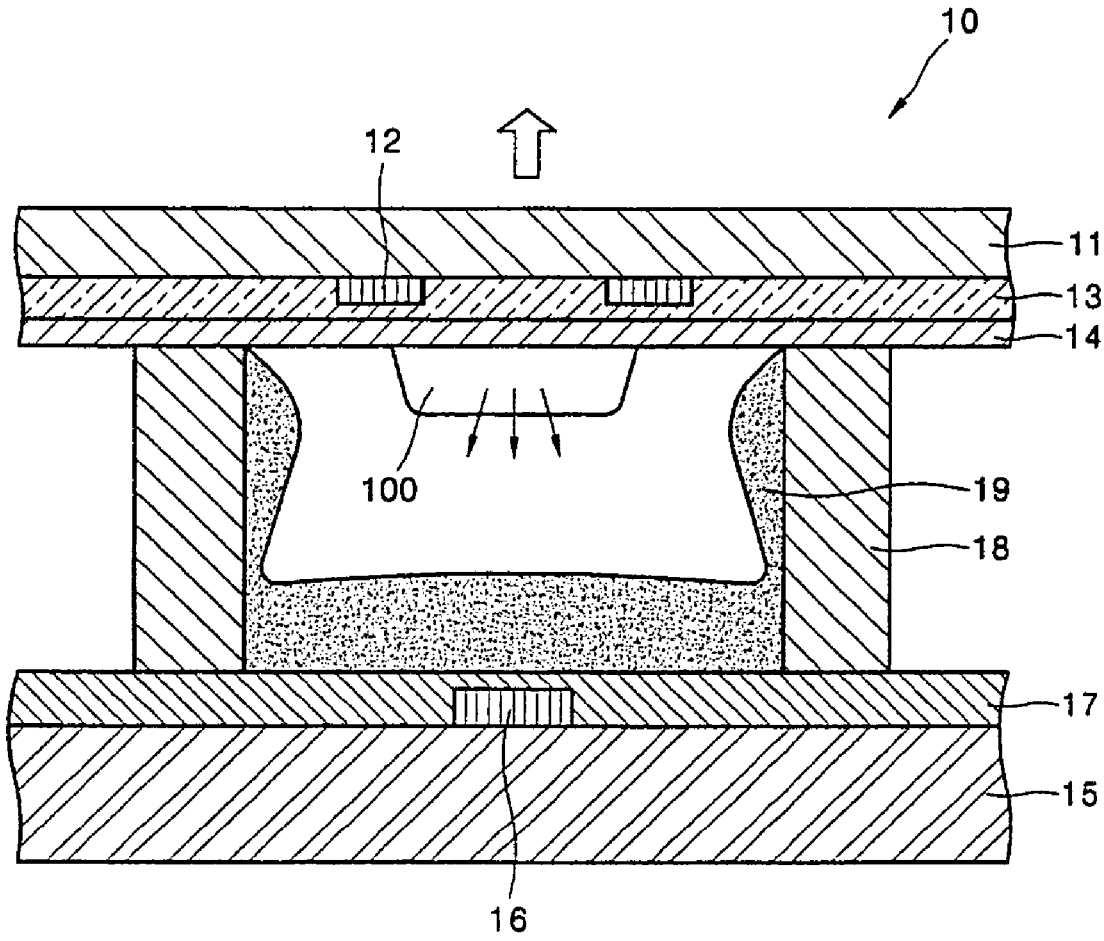
FIG. 1 is a cross-sectional view of a unit cell in a PDP.

FIG. 1 is a view of a cross section of a unit cell in a PDP 10.

Referring to FIG. 1, in the PDP 10, a sustain electrode 12 is formed on a front substrate 11, and the sustain electrode 12 is covered by a front dielectric layer 13. A protective layer 14 is formed on the front dielectric layer 13.

An address electrode 16 is formed on a rear substrate 15 that is disposed to face the front substrate 11, and a rear dielectric layer 17 is formed on the address electrode 16. A barrier rib 18 that defines the discharge space is formed on the rear dielectric layer 17, and a phosphor layer 19 of red, green, and blue colors formed on an upper surface of the rear dielectric layer 17 and an inner surface of the barrier rib 18.

On the other hand, an inner space between the front and rear substrates 11 and 15 is a discharge space 100, in which an inert gas is injected.

Figure 2:
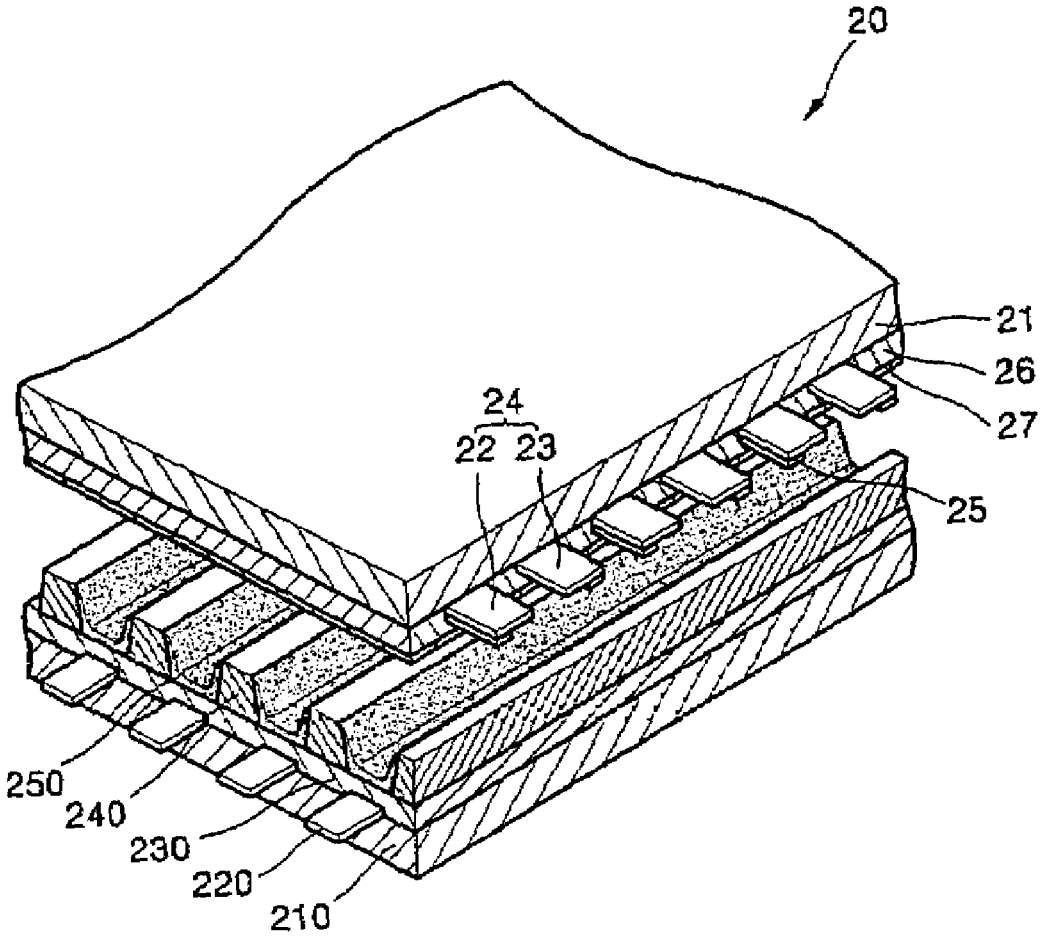
FIG. 2 is an exploded perspective view of a part of the PDP.

FIG. 2 is a view of another PDP 20.

Referring to FIG. 2, the PDP 20 includes a front substrate 21 and a rear substrate 210.

A sustain electrode 24, which includes an X electrode 22 and a Y electrode 23 that are alternately disposed in stripe forms is formed on a lower surface of the front substrate 21, and a bus electrode 25 is electrically connected to the X and Y electrodes 22 and 23 along the edges of the X and Y electrodes 22 and 23. The X and Y electrodes 22 and 23, and the bus electrode 25 are covered by a front dielectric layer 26, and a protecting layer 27 is coated on a surface of the front dielectric layer 26.

An address electrode 220 crossing the sustain electrode 24 is formed on an upper surface of the rear substrate 210, and the address electrode 220 is covered by a rear dielectric layer 230. A barrier rib 240 that defines a discharge space is disposed on the rear dielectric layer 230. A phosphor layer 250 of red, green, and blue colors is applied on an inner surface of the barrier rib 240 and a surface of the rear dielectric layer 230.

Figure 3:
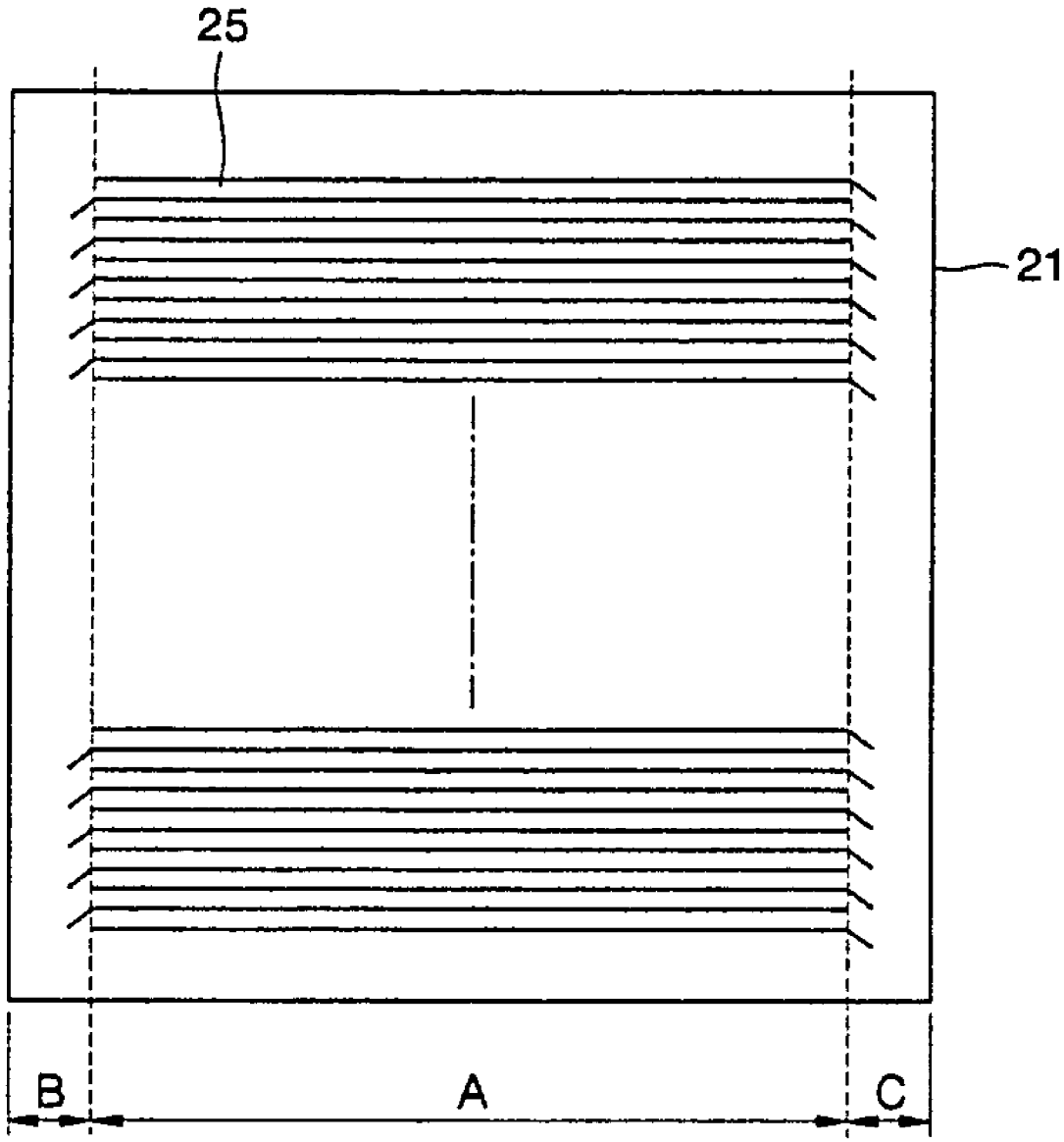
FIG. 3 is a plan view of a bus electrode of FIG. 2.

As shown in FIG. 3, in the PDP 20, the bus electrode 25 of stripe shape is disposed on the front substrate 21, and the bus electrode 25 is electrically connected to the sustain electrode 24 (refer to FIG. 2).

The front substrate 21 can be divided into a display area A that realizes images by forming pixels, and non-display areas B and C that are electrically connected to external terminals to transmit electric signals.

Figure 4:
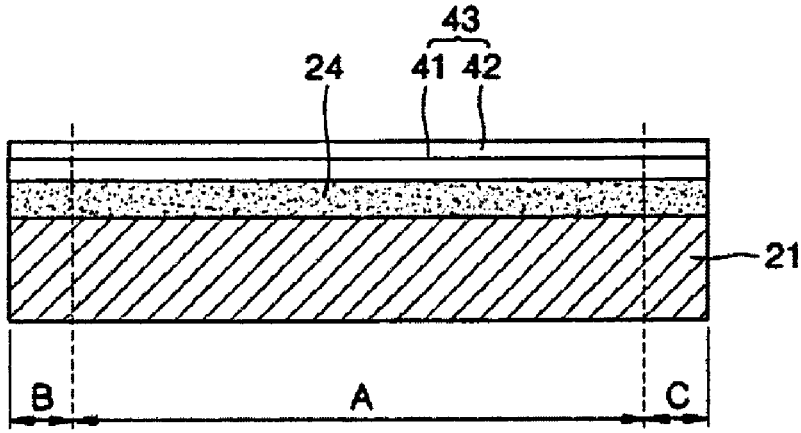
FIG. 4 is a cross-sectional view of a bus electrode.

FIG. 4 is a view of the bus electrode 43 on the display area A and the non-display areas B and C.

Referring to FIG. 4, the bus electrode 43 is formed on the sustain electrode 24 that is formed on the front substrate 21. The bus electrode 43 has a dual-layered structure including a first bus electrode 41 coated on the surface of the sustain electrode 24, and a second bus electrode 42 coated on an upper surface of the first bus electrode 41.

The first bus electrode 41 is a black layer functioning as a shielding layer, and the second bus electrode 42 is a white conductive layer. In addition, the first and second bus electrodes 41 and 42 have equal thicknesses on the display area A and the non-display areas B and C.

However, the bus electrode 43 formed on the PDP has the following problems.

Figure 5:
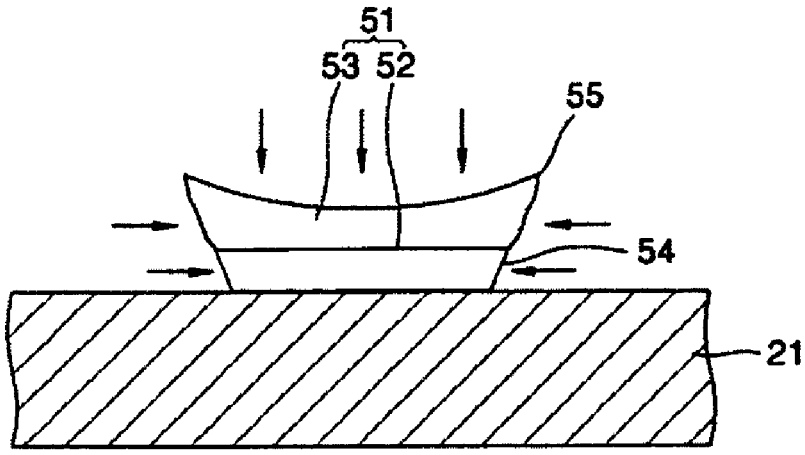
FIG. 5 is a cross-sectional view of a bus electrode of a dual-layered structure including an edge curl portion.

As shown in FIG. 5, the bus electrode 51 formed on the front substrate 21 has the dual-layered structure respectively including the black first bus electrode 52 and the white second bus electrode 53 on the display area and the non-display area.

When a raw material for forming the bus electrode 51 is printed and developed, the first bus electrode 52 is more vulnerable to a developing solution than the second bus electrode 53. Thus, undercut portions 54 are generated on both edges of the bus electrode 51 when it is formed.

Also, in an exposure process, since the first bus electrode 52 receives less ultraviolet rays than the second bus electrode 53, the first bus electrode 52 is less hardened than the second bus electrode 53. Thus, the first bus electrode 52 has a larger undercut portion 54 than the second bus electrode 53. If the undercut portion 54 is large, it may cause a short.

In addition, due to the undercut portion 54, both edge portions of the bus electrode 51 do not tend to contract downward. However, a center portion of the bus electrode 51 tends to contract downward. Accordingly, the center portion of the bus electrode 51 descends due to the contraction, and the edge portions rise, thus forming an edge curl portion 55 on the bus electrode 51.

Figure 6:
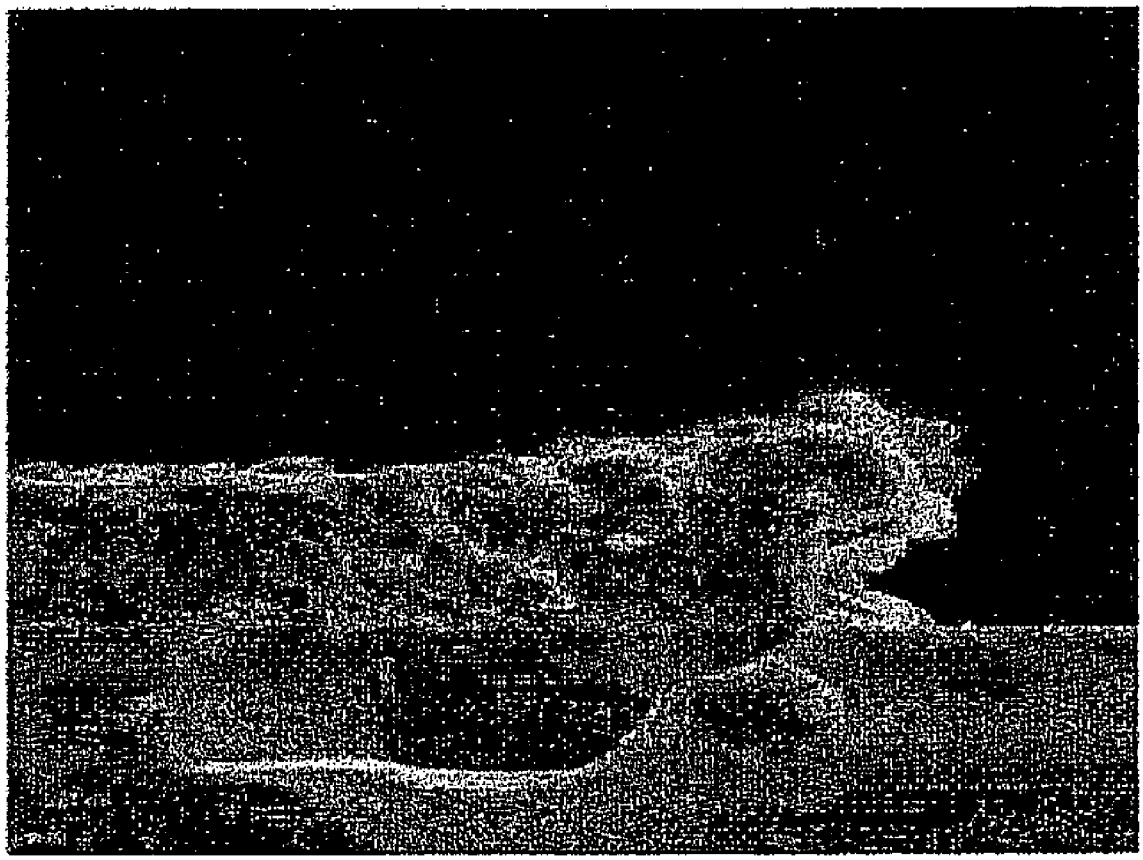
FIG. 6 is a Scanning Electron Microscope (SEM) picture of the bus electrode of dual-layered structure including the edge curl portion.

FIG. 6 is a Scanning Electron Microscope (SEM) picture of the bus electrode 51, on which the edge curl portion 55 is formed. When the edge curl portion 55 is formed, a withstand voltage of the PDP is lowered.

In addition, since the thickness of the bus electrode 51 patterned on the front substrate 21 is constant on the display area and on the non-display area, the cost of fabricating the bus electrode on the non-display area that is electrically connected to the external terminal increases greatly when the size of the PDP becomes larger. On the non-display area, the black layer that is formed to improve the contrast on the display area is unnecessary.

Figure 7:
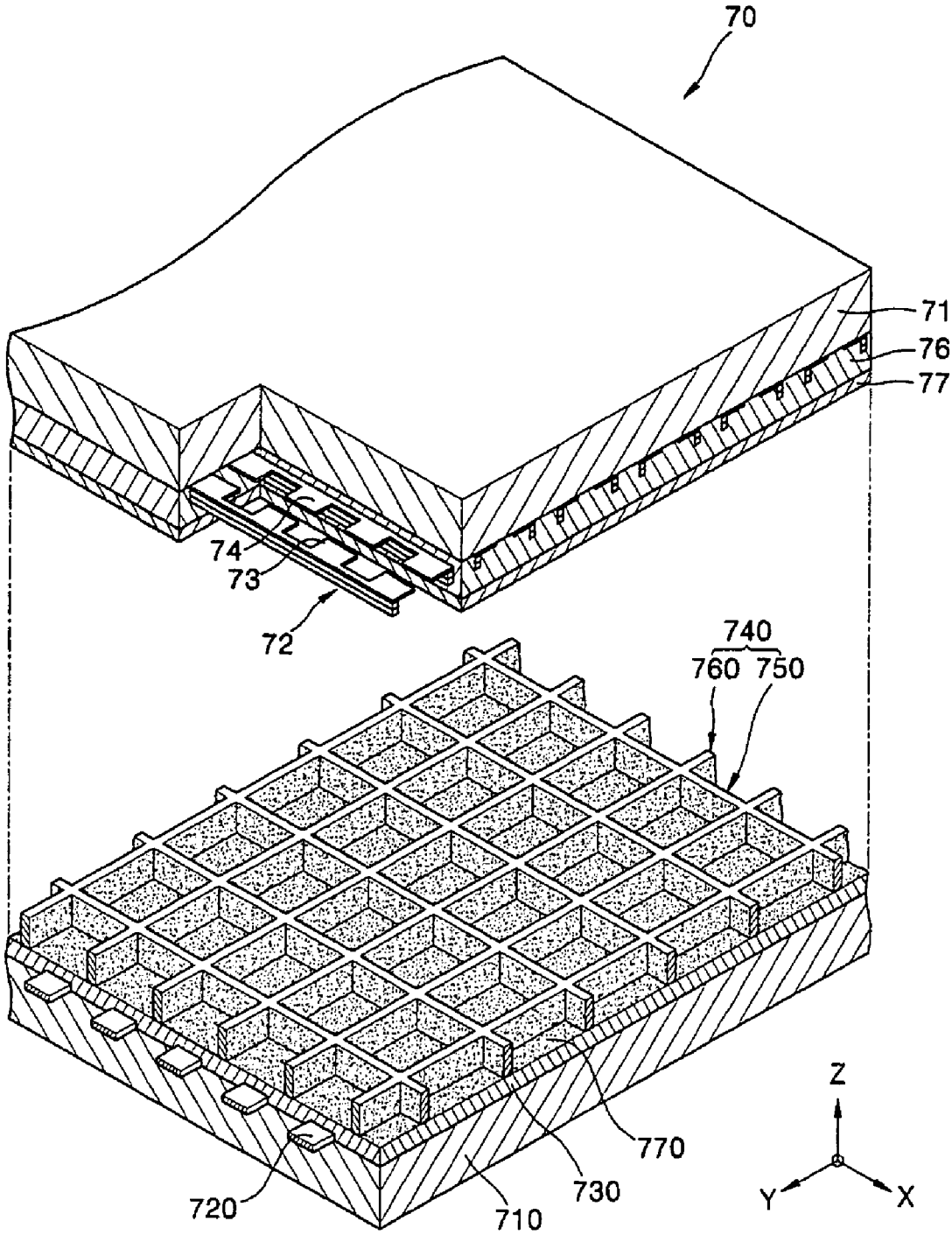
FIG. 7 is an exploded perspective view of a part of a PDP according to a first embodiment of the present invention.

FIG. 7 is a view of a Plasma Display Panel (PDP) 70 according to an exemplary embodiment of the present invention.

Referring to FIG. 7, the PDP 70 includes a front substrate 71, and a rear substrate 710 facing the front substrate 71.

Common electrodes 73 and scan electrodes 74 are alternately disposed on a lower surface of the front substrate 71 along Y direction. The common electrodes 73 and the scan electrodes 74 are formed of a transparent metal film, for example, an Indium Tin Oxide (ITO) film. Bus electrodes 72 are disposed on lower surface of the common and scan electrodes 73 and 74. The bus electrodes 72 are disposed along edges of the common and scan electrodes 73 and 74, and formed of a metal having a higher electric conductivity.

A front dielectric layer 76 is formed on the front substrate 71, on which the bus electrodes 72, the common electrodes 73, and the scan electrodes 74 are formed, for covering the electrodes. A protecting layer 77 is applied on an entire surface of the front dielectric layer 76.

Address electrodes 720 are formed on an upper surface of the rear substrate 710. The address electrodes 720 are disposed to cross the bus electrodes 72, and extend across the discharge cells.

A rear dielectric layer 730 is formed on the address electrodes 720 to cover the address electrodes 720.

Barrier ribs 740 are formed on an upper surface of the rear dielectric layer 730 to limit a discharge space and to prevent a cross talk from being generated. Each of the barrier ribs 740 includes a first barrier rib 750 that crosses the address electrode 720, and a second barrier rib 760 that is formed in parallel to the address electrode 720. The second barrier rib 760 extends from both sides of the first barrier rib 750, and forms a lattice shape. The barrier rib 740 may be of a meander type, a waffle type, or another type that defines the discharge space.

A phosphor layer 770 of red, green, or blue color is formed on inner walls of the barrier rib 740 and upper surface of the rear dielectric layer 730.

According to the present invention, the bus electrode 72 has different respective structures on a display area and a non-display area of the PDP 70.

The structure of the bus electrode 72 will be described in more detail as follows. The same reference numerals denote the same elements having the same functions.

Figure 8:
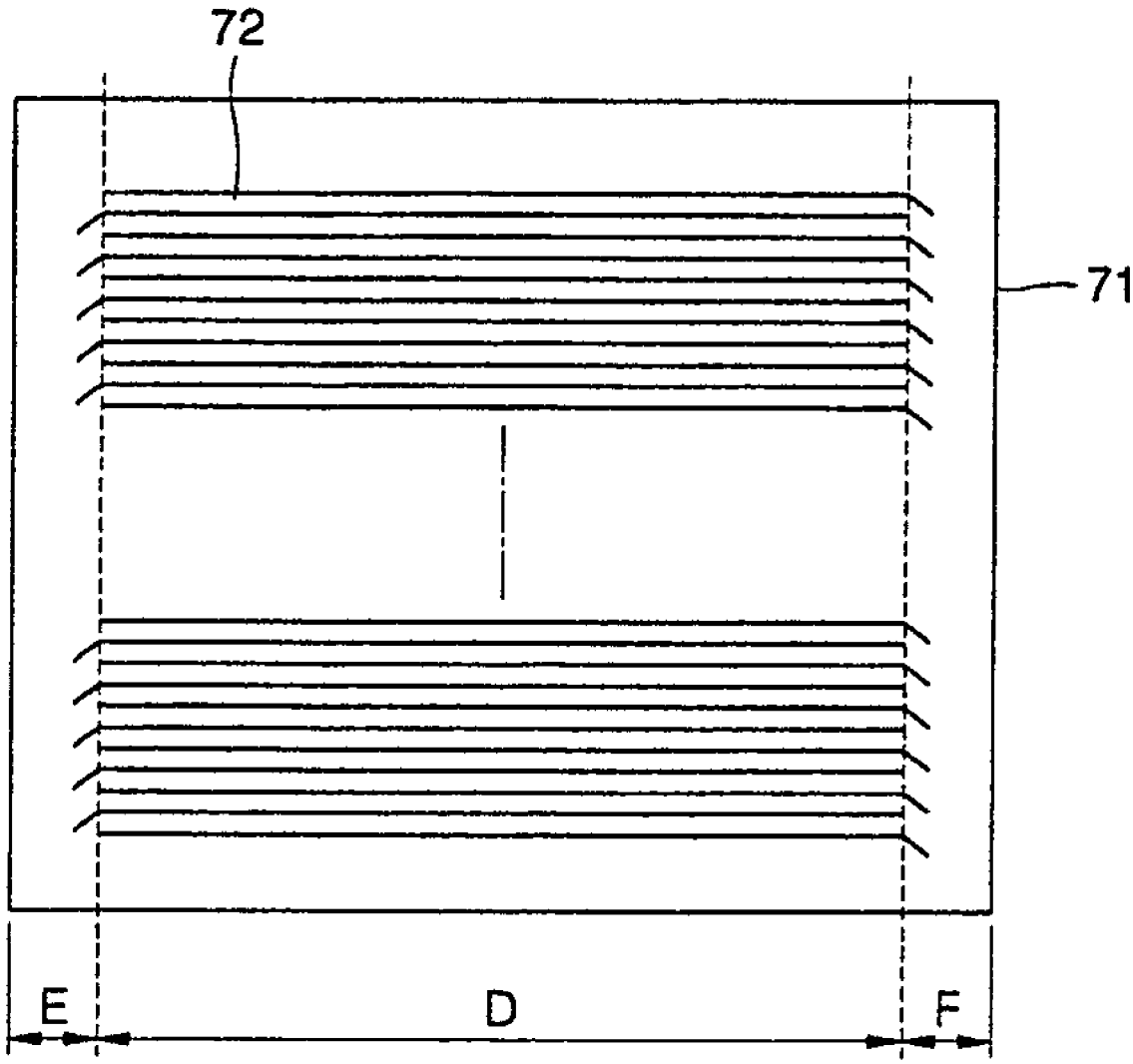
FIG. 8 is a plan view of a bus electrode of FIG. 7.

Referring to FIG. 8, the bus stripe electrode 72 is formed on the front substrate 71. A pair of common and scan electrodes 73 and 74 are electrically connected to the bus electrode 72 as shown in FIG. 7.

Hereinafter, in order to clarify the features of the present invention, the present invention will be described in detail except for the common and scan electrodes 73 and 74 that are formed as the transparent electrodes.

The front substrate 71 can be divided into a display area D that displays images by forming pixels, and non-display areas E and F that are formed on both sides of the display area D and transmit electrical signals by being electrically connected to external terminals.

The bus electrode 72 is disposed both on the display area D and non-display areas E and F, and the bus electrode 72 can be divided into a display unit bus electrode on the display area C and non-display unit bus electrodes on the non-display areas E and F. The display unit bus electrode and the non-display unit bus electrodes are connected integrally, and have different thicknesses from each other.

Figure 9:
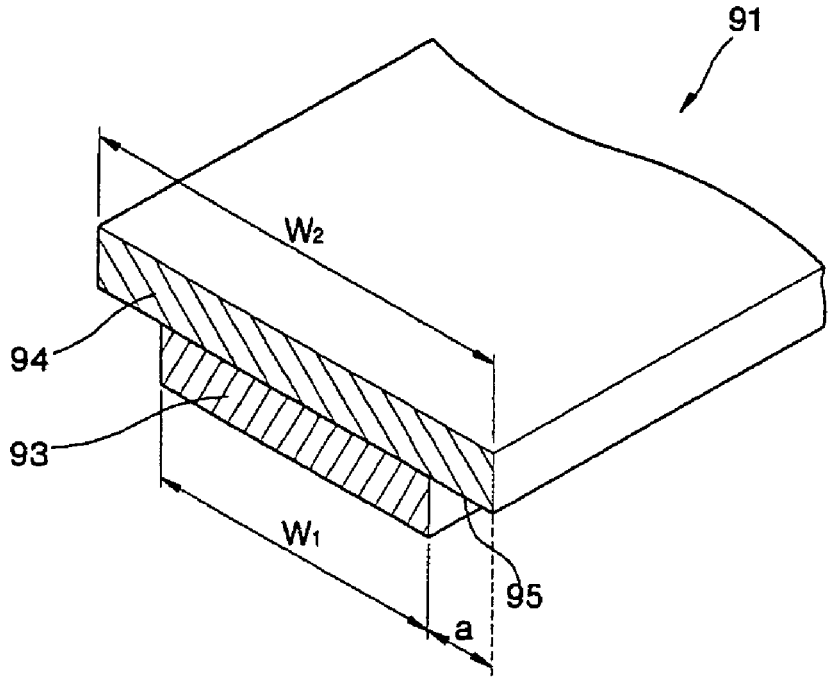
FIG. 9 is a perspective view of a bus electrode on a display area according to the first embodiment of the present invention.
Figure 10:
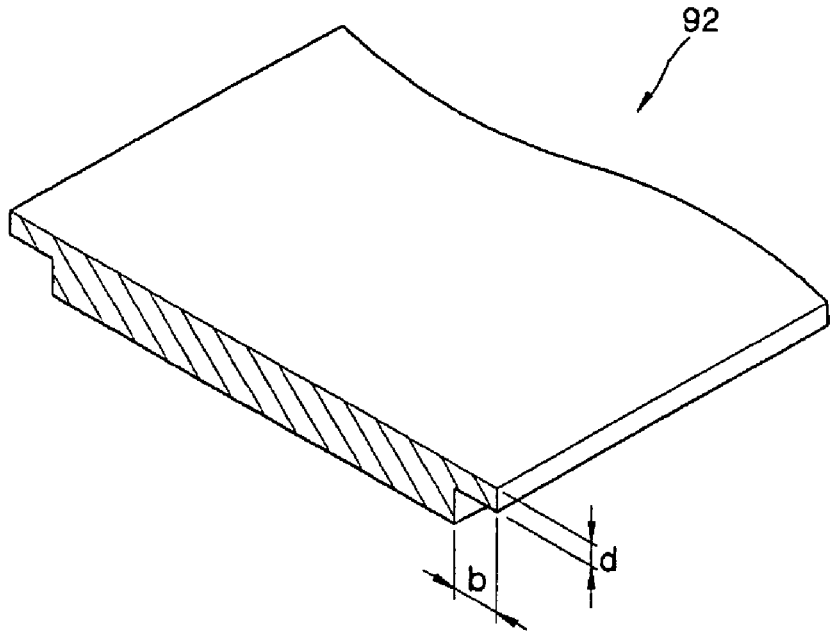
FIG. 10 is a perspective view of the bus electrode on a non-display area according to the first embodiment of the present invention.

FIGS. 9 and 10 are views of the bus electrode according to a first embodiment of the present invention.

Referring to FIG. 9, the bus electrode includes the display unit bus electrode 91 formed on the display area D, and non-display unit bus electrodes 92 formed on the non-display areas E and F.

The display unit bus electrode 91 includes a first bus stripe electrode 93. The first bus electrode 93 contacts the surface of the front substrate 71 (refer to FIG. 7).

The first bus electrode 93 functions as a shielding layer for improving a contrast of the PDP, and is a conductive or a nonconductive black layer. It is desirable that the first bus electrode 93 is formed of a material in which a black material such as Co, Cr, or Ru is mixed with a frit powder. The first bus electrode 93 is formed only on the display area D, and a thickness of the first bus electrode 93 is about 1~2 μm.

A second bus electrode 94 is formed on the first bus electrode 93. The second bus electrode 94 is overlapped with the first bus electrode 93 in a length direction thereof. The second bus electrode 94 functions as a reflective layer for improving the brightness of the PDP, and is a white conductive layer. It is desirable that the second bus electrode 94 is formed of a material, in which a material such as Ag, Al, Au, or Cu is mixed with a frit powder. A thickness of the second bus electrode 94 is about 5~6.5 μm.

The bus electrode 91 coated on the display area D has dual-layered structure, in which the first bus electrode 93 and the second bus electrode 94 coated on the first bus electrode 93 are formed.

Referring to FIG. 10, the non-display unit bus electrode 92 is formed on the front substrate 71. The non-display unit bus electrode 92 is formed of the same material like the second bus electrode 94, and is a conductive white layer. The non-display unit bus electrode 92 is formed through the same processes as those of the second bus electrode 94 on the display area D, and electrically connected to the second bus electrode 94.

The non-display unit bus electrode 92 coated on the non-display areas E and F is a single-layered structure, and does not include the black first bus electrode 93 that functions as the shielding layer, unlike the display unit bus electrode 91 coated on the display area D.

The non-display unit bus electrode 92 coated on the non-display areas E and F does not include the black first bus electrode 93, because the non-display areas E and F are not the display areas of the PDP and do not need to improve the contrast.

On the other hand, the first bus electrode 93 and the second bus electrode 94 overlapped on the display area D include a portion a that is exposed through a developing and an exposure process after being printed.

That is, a width W2 of the second bus electrode 94 is larger than that W1 of the first bus electrode 93. The black first bus electrode 93 receives less ultraviolet rays than the white second bus electrode 94, and is developed well by the developing solution. Thus, the undercut portion 95 of the first bus electrode 93 is larger than that of the second bus electrode 94.

Therefore, the portion a on edges where the first and second bus electrodes 93 and 94 contact each other is formed as the undercut portion 95. The portion a can improve the brightness on the discharge space. When the developing operation is performed for a few~tens of seconds for forming the portion a, a portion b corresponding to the undercut portion 95 is formed on the non-display unit bus electrode 92. The portions a and b are the undercut portions that are generated when the bus electrodes are formed, or portions that are designed to improve the brightness.

Therefore, the thicknesses of the display unit bus electrode 9 land the non-display unit bus electrode 92 should be controlled within predetermined ranges. That is, the undercut portion a of the display unit bus electrode 92 and the undercut portion b of the non-display unit bus electrode 92 satisfy the following after the developing operation.

$$a>b, \text{ and}$$

$$0.1\ \mu m \leqq a \leqq 30\ \mu m,\ 0\ \mu m \leqq b \leqq 25\ \mu m$$

The above relationships mean that the undercut portion a of the display unit bus electrode 91 that has dual-layered structure is larger than the undercut portion b of the non-display unit bus electrode 92 that has the single-layered structure after performing the developing operation. In addition, ranges of the portions a and b are the portions where the undercut portions can be generated, and the portion b is in a smaller range since it has a smaller undercut portion.

Figure 11:
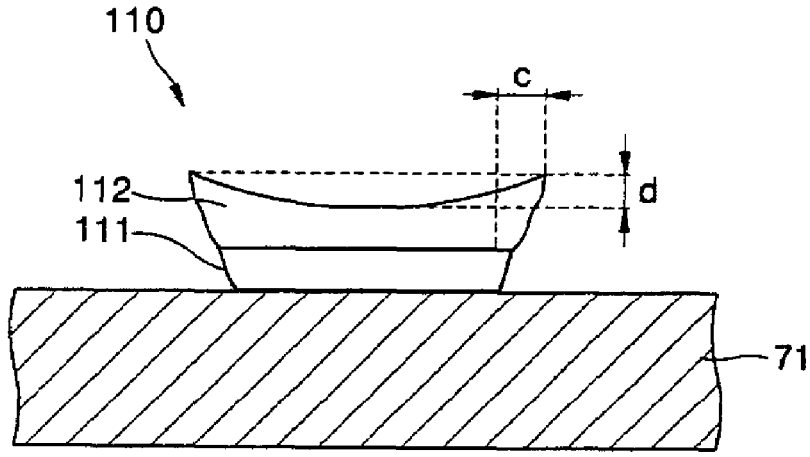
FIG. 11 is a cross-sectional view of the bus electrode on the display area, which includes an undercut portion according to the present invention.
Figure 12:
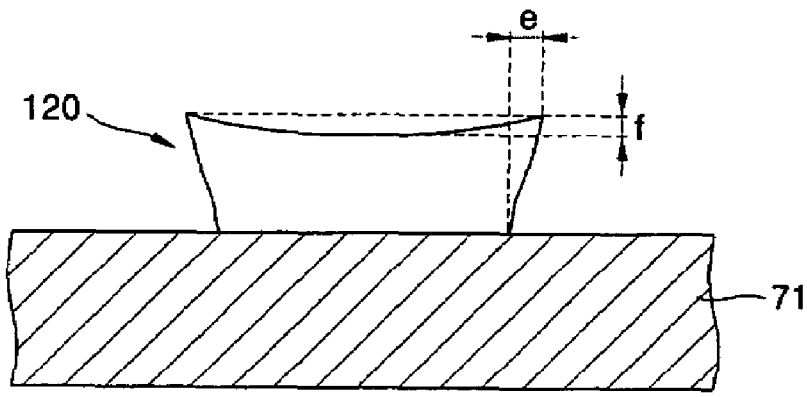
FIG. 12 is a cross-sectional view of the bus electrode on the non-display area, which includes the undercut portion according to the present invention.

FIG. 11 is a view of the display unit bus electrode 110, on which the undercut portion is actually formed, and FIG. 12 is a view of the non-display unit bus electrode 120.

Referring to the drawings, the undercut portion of the display unit bus electrode 110 is referred to as c, and a height of the edge curl portion is referred to as d. In addition, the undercut portion of the non-display unit bus electrode 120 of the single-layered structure is referred to as e, and a height of the edge curl portion is referred to as f.

In this case, the undercut portion c of the display unit bus electrode 110 and the undercut portion e of the non-display unit bus electrode 120 after the baking process satisfy the following in equation. In addition, the height d of edge curl portion of the display unit bus electrode 110 and the height f of the edge curl portion of the non-display unit bus electrode 120 satisfy the following equations.

$$c>e,\ d>f$$

$$0.1\ \mu m \leqq c \leqq 25\ \mu m,\ 0\ \mu m \leqq e \leqq 25\ \mu m,$$

$$0.1\ \mu m \leqq d \leqq 15\ m, \text{ and } 0\ \mu m \leqq f \leqq 10\ \mu m$$

Figure 13:
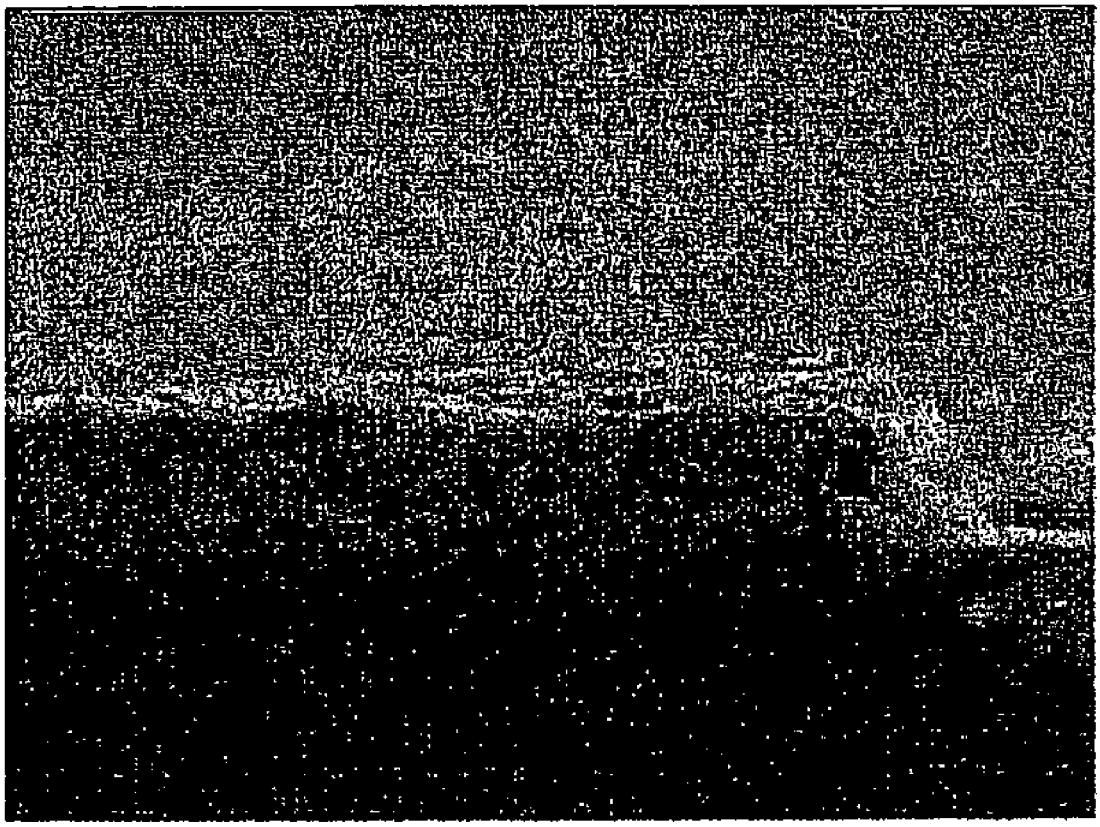
FIG. 13 is a SEM picture of the bus electrode on the non-display area according to the present invention.

The above relationships mean that the undercut portion c of the display unit bus electrode 110 having the dual layered structure is larger than that e of the non-display unit bus electrode 120 having the single layered structure after the baking process. Also, c and e are in ranges where the undercut portions can be generated, and e is in the smaller range than c. In addition, d and f0 are in ranges where the edge curl portions can be generated, and f is in the smaller range that d. FIG. 13 is a scanning electron microscope (SEM) picture showing the non-display unit bus electrode 120, and it hardly has an edge curl portion.

Actually, when the present inventor fabricated the PDP according to the present embodiment to measure the withstand voltage of the panel, since the non-display area had smaller edge curl portion, the withstand voltage was improved higher than that of the comparison example as shown below.

| | Comparison example | | Present invention embodiment | |
|---|---|---|---|---|
| Area | Display area | Non-display area | Display area | Non-display area |
| Shape | Dual layers | Dual layers | Dual layers | Single layer |
| Thickness of electrode | 6.5 μm | 6.5 μm | 6.5 μm | 5 μm |
| Edge curl (maximum thickness-minimum thickness) | 2 μm | 2 μm | 2 μm | 0.3 μm |
| Withstand voltage of panel | 800 V | | 950 V | |

Processes of forming the display and non-display unit bus electrodes 91 and 92 shown in FIGS. 9 and 10 on the front substrate 71 shown in FIG. 8 will be described as follows.

First, the front substrate 71 of transparent glass material is provided.

Then, a raw material for forming the black first bus electrode 93 that functions as the shielding layer is entirely printed on the display area D of the front substrate 71. The material of the first bus electrode 93 is not printed on the non-display areas E and F.

After printing the raw material of the first bus electrode 93 on the display area D, a raw material for forming the second bus electrode 94 and the non-display unit bus electrode 92 is printed on the display area D, and the non-display areas D and F connecting to the electrode and the external terminals. The raw materials for the second bus electrode 94 and for the non-display unit bus electrode 92 are actually the same, thus the printing operation can be performed through one printing operation.

Accordingly, on the display area D, the raw material for the first bus electrode 93 is printed as the first layer, and the raw material for the second bus electrode 94 is printed as the second layer on the first bus electrode 93. On the contrary, on the non-display areas E and F, the raw material for the non-display unit bus electrode 92 that is same as that of the second bus electrode 94 is printed, thus forming the single layered structure. The raw material of the second bus electrode 94 is connected to that of the non-display unit bus electrode 92. Otherwise, the materials for the second bus electrode 94 and the non-display unit bus electrode 92 can be printed separately from each other.

Next, the material for the bus electrode 92 or 94 is dried, and is exposed and developed for 5~25 seconds in a developing solution such as Na2CO3 using a mask having a desired pattern, for example, a stripe pattern. Accordingly, the display unit bus electrode 91 of dual-layered structure and the non-display unit bus electrode 92 of single-layered structure are formed on the front substrate 71.

In the developing process, both edges of the first bus electrode 93 printed under the second bus electrode 94 are undercut by the flowing developing solution. Accordingly, undercut portions 95 are formed on the edges of the first bus electrode 95. Otherwise, a portion a corresponding to the undercut portion may be optionally generated in order to improve the brightness of the panel by controlling the developing time.

When the undercut portion 95 is formed on the display unit bus electrode 91, and the portion b, the undercut portion is formed on the edges of the non-display unit bus electrode 92 due to the flowing developing solution.

After the display unit bus electrode 91 and the non-display unit bus electrode 92 are formed, they are baked at a high temperature.

Figure 14:
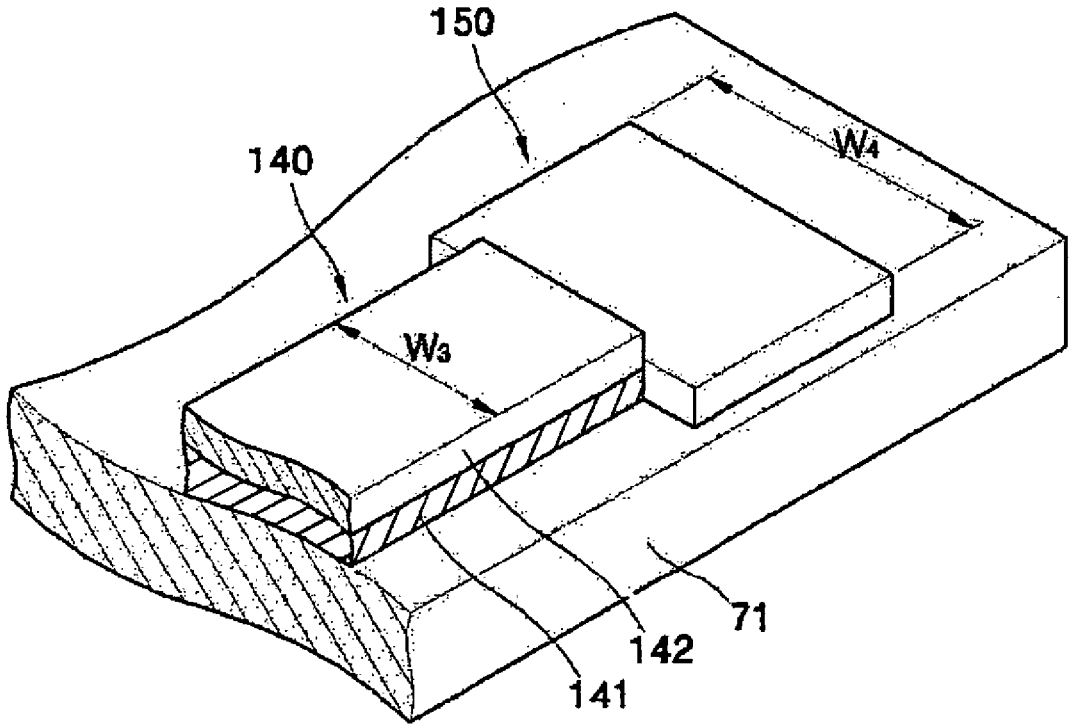
FIG. 14 is a cross-sectional view of a bus electrode according to a second embodiment of the present invention.

FIG. 14 is a view of a bus electrode according to a third embodiment of the present invention.

Referring to FIG. 14, the bus electrode includes a display unit bus electrode 140 and a non-display unit bus electrode 150 that is electrically connected to the display unit bus electrode 140.

The display unit bus electrode 140 has the dual-layered structure including a black first bus electrode 141 that is coated on the front substrate 71, and a white second bus electrode 142 that is coated on the upper surface of the first bus electrode 141.

The non-display unit bus electrode 150 is coated on the front substrate 71, and has the single-layered structure that is electrically connected to at least one electrode in the display unit bus electrode 140.

Since the non-display unit bus electrode 150 is thinner than the display unit bus electrode 140, a short can occur. In order to prevent the short from occurring, it is desirable that a width W4 of the non-display unit bus electrode 150 is greater than the width W3 of the display unit bus electrode 140. Therefore, the display unit bus electrode 140 can be formed thinner with the single layer instead of being wider as with the non-display unit bus electrode 150, thus reducing the raw material cost.

Figure 15:
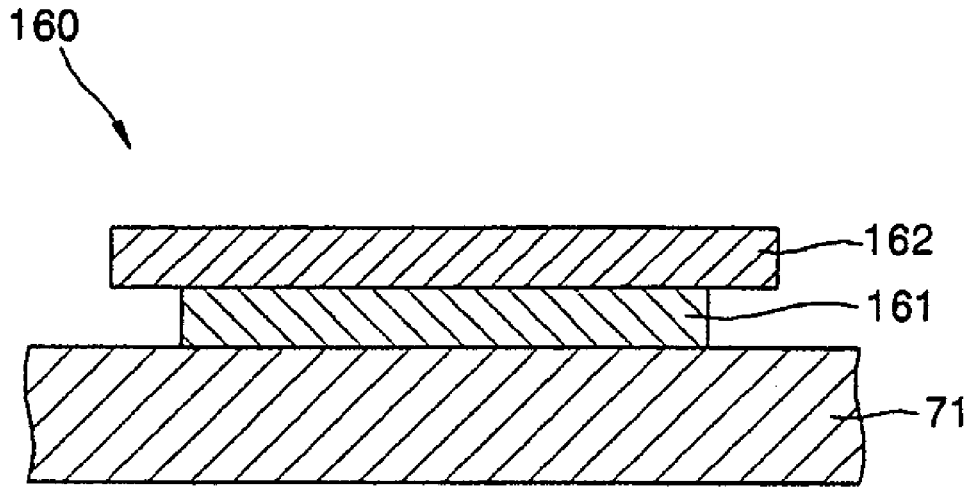
FIG. 15 is a cross-sectional view of a bus electrode on a display area according to a third embodiment of the present invention.
Figure 16:
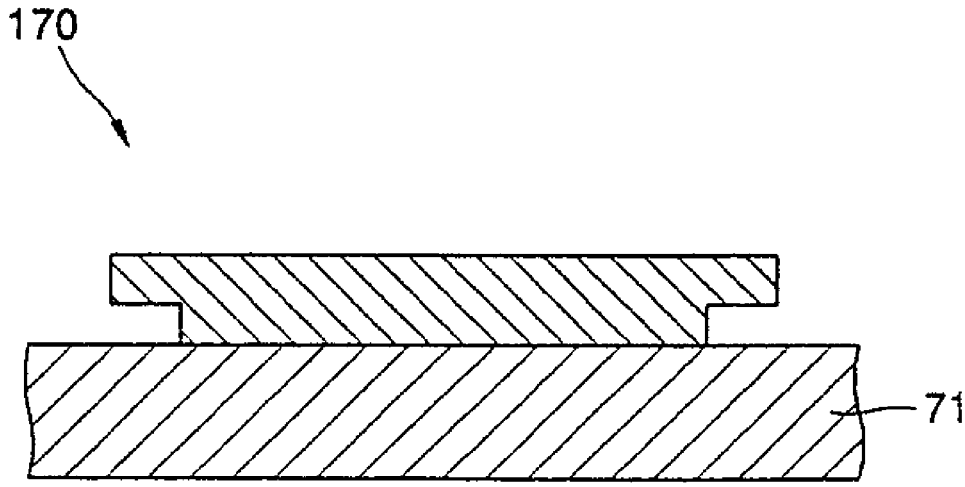
FIG. 16 is a cross-sectional view of the bus electrode on a non-display area according to the third embodiment of the present invention.

FIGS. 15 and 16 are views of a bus electrode according to a fourth embodiment of the present invention.

Referring to FIGS. 15 and 16, the bus electrode includes a display unit bus electrode 160 formed on the display area and a non-display unit bus electrode 170 formed on the non-display area.

The display unit bus electrode 160 includes a first bus electrode 161 formed on the front substrate 71, and a second bus electrode 162 formed on the first bus electrode 161. The first and second bus electrodes 161 and 162 are white and are formed of same material.

On the contrary, the non-display unit bus electrode 170 is electrically connected to at least one electrode of the display unit bus electrode 160, and is a single layer formed on the front substrate 71. The non-display unit bus electrode 170 is also white.

That is, the black bus electrode that functions as the shielding layer is not included in the display unit bus electrode 160, as well as in the non-display unit bus electrode 170 unlike the other embodiments of the present invention. Therefore, the brightness of the panel can be improved greatly.

As described above, according to the PDP and the fabrication method of the PDP of the present invention, since the non-display unit bus electrode formed on the non-display area includes a single-layered structure while the display unit bus electrode formed on the display area includes a double-layered structure, the cost for the material of the bus electrode on the non-display area, which is not related to the image quality of the panel, can be reduced.

In addition, since the non-display area is formed as the single layered structure, the edge curl portion on the non-display area can be reduced and the withstand voltage of the panel can be improved.

The white bus electrode that is coated on the bus electrode that functions as the shielding layer on the display area is larger than the bus electrode of the shielding layer, and the brightness of the panel can thus be improved.

Also, the width of the non-display unit bus electrode on the non-display area is increased, and the thickness of the non-display unit bus electrode is reduced, thereby reducing the cost of fabricating the electrode and preventing electrical shorts with the display unit bus electrode from occurring on the display area.

While the present invention has been particularly shown and described with reference to exemplary embodiments thereof, it will be understood by those of ordinary skill in the art that various modifications in form and detail may be made therein without departing from the spirit and scope of the present invention as recited in the following claims.

What is claimed is:

1. A plasma display panel comprising:

a front substrate;

a common electrode and a scan electrode arranged on a lower surface of the front substrate;

a bus electrode electrically connected to the common electrode and the scan electrode;

a front dielectric layer covering the common electrode, the scan electrode, and the bus electrode;

a rear substrate facing the front substrate;

an address electrode arranged on an upper surface of the rear substrate to cross the bus electrode;

a barrier rib arranged between the front and rear substrates; and a phosphor layer arranged on a discharge space defined by the barrier rib;

wherein the bus electrode includes a display unit bus electrode arranged on a display area that displays pixels and a non-display unit bus electrode arranged on a non-display area electrically connected to the display unit bus electrode and connected to an external terminal, and wherein the display unit bus electrode and the non-display unit bus electrode have different structures;

wherein the display unit bus electrode includes a dual-layered structure of a first bus electrode and a second bus electrode arranged on the first bus electrode, the first bus electrode being arranged close to the front substrate than the second bus electrode;

wherein the second bus electrode is wider than the first bus electrode; and wherein the non-display unit bus electrode includes a single-layered structure electrically connected to the external terminal.

2. The plasma display panel of claim 1, wherein the first bus electrode is black.

3. The plasma display panel of claim 2, wherein the first bus electrode comprises cobalt, chrome, or ruthenium mixed with a fit.

4. The plasma display panel of claim 1, wherein the second bus electrode is white.

5. The plasma display panel of claim 4, wherein the second bus electrode comprises silver, aluminum, or copper mixed with a fit.

6. The plasma display panel of claim 1, wherein the non-display unit bus electrode comprises a same material as one electrode in the display unit bus electrode.

7. The plasma display panel of claim 1, wherein the non-display unit bus electrode is wider than the display unit bus electrode.

8. The plasma display panel of claim 1, wherein an undercut portion and an edge curl portion are arranged along edges of the display unit bus electrode and the non-display unit bus electrode.

9. The plasma display panel of claim 1, wherein the display unit bus electrode includes a white first bus electrode and a white second bus electrode arranged on the first bus electrode.

10. A plasma display panel, comprising:

a front substrate;

a common electrode and a scan electrode arranged on a lower surface of the front substrate;

a bus electrode electrically connected to the common electrode and the scan electrode;

a front dielectric layer covering the common electrode, the scan electrode, and the bus electrode;

a rear substrate facing the front substrate;

an address electrode arranged on an upper surface of the rear substrate to cross the bus electrode;

a barrier rib arranged between the front and rear substrates; and a phosphor layer arranged on a discharge space defined by the barrier rib;

wherein the bus electrode includes a display unit bus electrode arranged on a display area that displays pixels and a non-display unit bus electrode arranged on a non-display area electrically connected to the display unit bus electrode and connected to an external terminal, and wherein the display unit bus electrode and the non-display unit bus electrode have different structures;

wherein the display unit bus electrode includes a dual-layered structure of a first bus electrode and a second bus electrode arranged on the first bus electrode, the first bus electrode being arranged close to the front substrate than the second bus electrode;

wherein the second bus electrode is wider than the first bus electrode;

wherein the non-display unit bus electrode includes a single-layered structure electrically connected to the external terminal; and wherein an undercut portion c of the display unit bus electrode, an undercut portion e of the non-display unit bus electrode, a height d of the edge curl portion on the display unit bus electrode, and a height f of the edge curl portion on the non-display area satisfy the following:

$$c>e,\ d>f$$

$$0.1\ \mu m \leqq c \leqq 25\ \mu m,\ 0\ \mu m \leqq e \leqq 25\ \mu m,$$

$$0.1\ \mu m \leqq d \leqq 15\ \mu m,\ \text{and}\ 0\ \mu m \leqq f \leqq 10\ \mu m.$$

* * * * *